US008002876B2

(12) United States Patent
Frank

(10) Patent No.: US 8,002,876 B2
(45) Date of Patent: Aug. 23, 2011

(54) METHOD AND APPARATUS FOR ELECTROSTATICALLY CHARGING AND SEPARATING PARTICLES THAT ARE DIFFICULT TO SEPARATE

(75) Inventor: Werner Jakob Frank, Bergisch-Gladbach (DE); Helga Frank, legal representative, Bergisch Gladbach (DE)

(73) Assignee: Balcke-Durr GmbH, Ratingen (DE)

( * ) Notice: Subject to any disclaimer, the term of this patent is extended or adjusted under 35 U.S.C. 154(b) by 712 days.

(21) Appl. No.: 11/794,960

(22) PCT Filed: Jan. 9, 2006

(86) PCT No.: PCT/EP2006/000106
§ 371 (c)(1),
(2), (4) Date: Jul. 9, 2008

(87) PCT Pub. No.: WO2006/074888
PCT Pub. Date: Jul. 20, 2006

(65) Prior Publication Data

US 2009/0165648 A1 Jul. 2, 2009

(30) Foreign Application Priority Data

Jan. 11, 2005 (EP) ..... 05000380

(51) Int. Cl.
*B03C 3/014* (2006.01)
*B03C 3/12* (2006.01)

(52) U.S. Cl. ..... 95/73; 95/78; 95/79; 96/62; 96/73; 96/74; 96/76; 96/77

(58) Field of Classification Search ..... 95/73, 79, 95/78; 96/73–79, 60, 62
See application file for complete search history.

(56) References Cited

U.S. PATENT DOCUMENTS

| | | | | |
|---|---|---|---|---|
| 1,343,285 | A | 6/1920 | Schmidt | |
| 3,518,462 | A * | 6/1970 | Brown | 310/10 |
| 3,907,520 | A * | 9/1975 | Huang et al. | 95/62 |
| 4,178,156 | A * | 12/1979 | Tashiro et al. | 95/59 |
| 4,203,948 | A * | 5/1980 | Brundbjerg | 422/121 |
| 4,225,323 | A * | 9/1980 | Zarchy et al. | 95/73 |
| 4,264,343 | A | 4/1981 | Natarajan et al. | |
| 5,055,118 | A * | 10/1991 | Nagoshi et al. | 96/88 |
| 5,290,343 | A * | 3/1994 | Morita et al. | 96/39 |
| 5,302,190 | A * | 4/1994 | Williams | 95/57 |
| 6,004,376 | A | 12/1999 | Frank | 95/79 |
| 6,524,369 | B1 * | 2/2003 | Krigmont | 95/78 |

OTHER PUBLICATIONS

International Preliminary Report, PCT/IB/373, dated Aug. 14, 2007.

* cited by examiner

*Primary Examiner* — Richard L Chiesa
(74) *Attorney, Agent, or Firm* — Baker & Hostetler LLP

(57) ABSTRACT

The invention relates to an electrostatic filter method and electrostatic filter for separating particles from industrial waste gases, wherein an optimal electric charging or ionization in the ionization zone are performed in a high-voltage zone and its unchanged ducts with one high-voltage supply source to ensure the subsequent particle separation in the separation zone at sufficient field strength which requires minimal energy input.

7 Claims, 3 Drawing Sheets

Fig. 1 Particle separation performance in the electrostatic filter
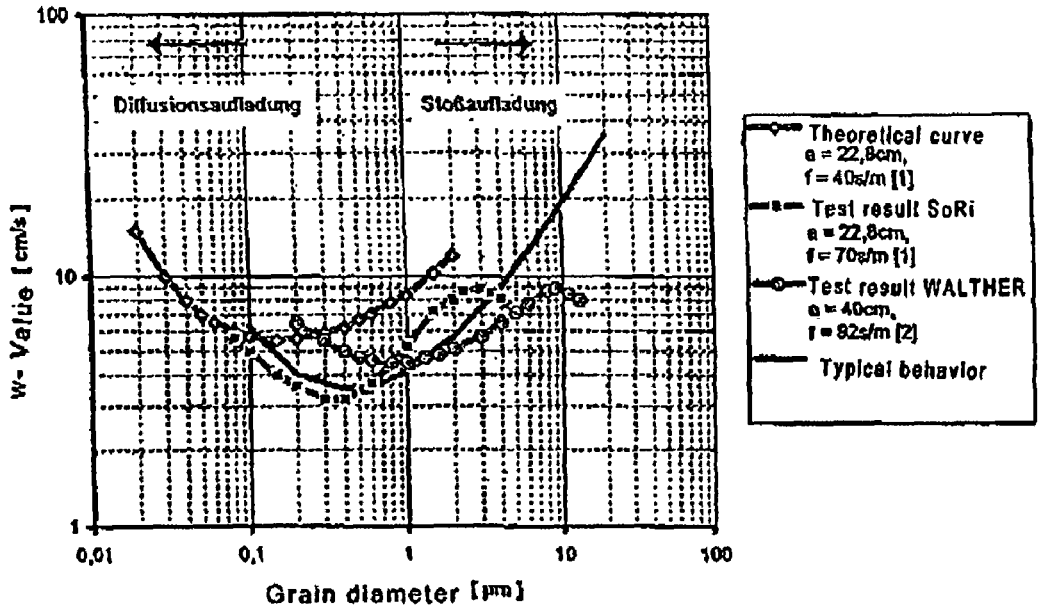
Fig. 2 Examples of individual characteristics of negative electrode forms for the ionization and separation zone
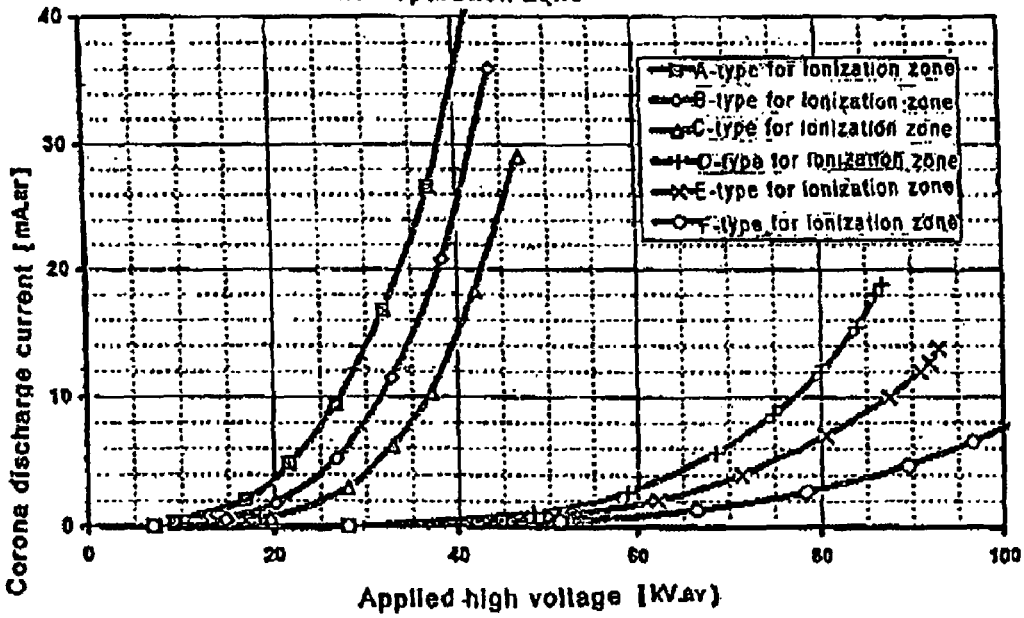

11
1
5
3
4
6
2
7
3
12
Flow 11
1
5a
4a
5
4
2
Flow
7a
6a
3
7
12
6

11
14
3
7
5
4
6
2
1
Flow
13
12
8
4

11
14
3
5a
7
4a
6
5
6
4
2
1
Flow
13
12
8

11
14
3
7
5
9
4
10
2
1
Flow
13
12
8
12
6

METHOD AND APPARATUS FOR ELECTROSTATICALLY CHARGING AND SEPARATING PARTICLES THAT ARE DIFFICULT TO SEPARATE

CROSS-REFERENCE TO RELATED APPLICATIONS

This application is the National Stage of International Application No. PCT/EP2006/000106 filed Jan. 9, 2006, which claims the benefit of European Application No. EP 05000380.5 filed Jan. 11, 2005, the entire disclosure of which is incorporated herein by reference.

FIELD OF THE INVENTION

The subject matter of the invention is a method and apparatus for electrostatically charging and separating particles that are difficult to separate from a gas fluid. In other words, it concerns an electrostatic filter, and especially such an electrostatic filter methods or electrostatic filters which are suitable for filtering industrial waste gas.

BACKGROUND OF THE INVENTION

In the case of electrostatic filters for dust separation in industrial waste gases which operate according to the so-called Cottrell principle and which can also be designated as electrostatic separating apparatuses, the changing and transport of the particles to be separated and their depositing on optionally specially formed collecting electrodes occur simultaneously in an electric field, with the particles, after sufficient accumulation or agglomeration, being removed from the collecting electrode either by mechanical vibration (dry dedusting) or by rinsing (wet dedusting). If necessary, several of the aforementioned electric fields are switched in series or also in parallel in order to achieve the desired total separating output.

The reason that some particles are difficult to separate may be caused by the electric properties of the particles which as a result of their chemical and physical properties lead to an insulating layer on the collecting electrode. An additional factor is that as a result of the electric flow turbulence or the so-called electric wind at high current density the share of particles in the grain range<10 μm can be deposited only with more difficulty on the collecting electrode in the region between the charging and the separating electrodes as a result of gas ionization. It is known that as a result of the physically effective charging mechanisms, namely the so-called surge or field charging and the diffusion charging, a more or less strong minimum of particle fraction separating performance occurs. In order to counteract the problems of electric flow turbulence as a result of electric wind, so-called two-stage electrostatic filters were developed, in which the charging and the separating of the particles occur in successively switched separated electric fields. The problematic aspect is the necessary spatial separation of the stages and their different electric high-voltage supply.

In order to solve this problem, an electrostatically working separator for dedusting industrial waste gases is known which works with a negative corona system. A method is known in particular in which particles difficult to separate are removed from a gas fluid with the help of electrostatic charging and separating by means of only one high-voltage source for a high-voltage zone. In contrast to the so-called Cottrell electrostatic filters, the particles are ionized successively and not simultaneously within the high-voltage zone and are thus separated. Moreover, a larger geometrical duct distance is in the ionization zone in this method and in these apparatuses than in the separating zone, as a result of which the field strength of the ionization zone is lower than the field strength of the separating zone. It has thus been managed to substantially avoid the disadvantages of electric turbulence. The duct width for the ionization zone was therefore provided with a larger arrangement in the known filters than the duct width of the separating zone because it was expected that in the comparatively small charging or ionization zone the expected very high, but necessary specific current flow would lead to a relatively early occurring sparkover activity which thus would limit the electric power. This means therefore that in the known filters an ionization zone is associated with at least two, but frequently even three and more separating zones. The presence of a sufficiently high field strength is ensured in the separating zone by the reduction of the duct width.

Similarly working air filters are known from the state of the art, even for purifying breathing air, which are used especially in households, restaurants and lecture halls. Air filters and industrial filters cannot be compared with each other because air filters need to fulfill completely different preconditions than the large industrial electrostatic filters which are concerned here. As a result, they cannot be used for cleaning industrial gases. Duct widths of 200 to 500 mm are usually used in electrostatic filters for industrial waste gases for example. This leads to the consequence, in combination with the composition of the exhaust gases and their flue-gas temperature, that field strengths in the range of 2 to 4 kV/cm and specific currents in the range of 0.2 to 1.2 mA/m$^2$ are usually used in industrial electrostatic filters.

Air filters are also known which each work with a positive corona system and two high voltages. These air filters comprise a rectifier with two outputs for ionization and separation. The field strengths in the known air filters are the same in the ionization and separation zone, but are provided with different voltage potentials. Both zones must be provided with a configuration so as to electrically insulated from each other. Moreover, positive discharge electrodes are provided in the known filters in the ionization zone, which electrodes produce a moderate ionization.

Before the background of ever rising demands placed on the energy efficiency of industrial appliances, the invention is based on the object of avoiding the disadvantages of the described electrostatic filters and electrostatic filter methods and to reduce the energy input in the filtering of industrial waste gases.

SUMMARY OF THE INVENTION

This object is achieved in accordance with the invention by the method and apparatus described herein. Preferred further developments of the method and the apparatus are described in further detail herein.

The separator in accordance with the invention and the separating method in accordance with the invention therefore work with a negative corona system, in which a just sufficient charging of the particles is carried out in each high-voltage zone with the help of only one high-voltage source. The transport of the charged particles and their separation therefore occurs at the lowest additional energy input at the oppositely polarized collecting electrodes, with the individual ducts known from conventional filters with negative corona systems remaining unchanged.

This means that in a region of extreme ionization with a respectively high electric turbulence and electric wind transversally to the gas flow a substantially calmed and virtually laminar region follows substantially without any electric turbulence, in which the separation of the charged particles that are difficult to separate can occur in a highly efficient and unhindered manner.

The efficient charging of the particles which occurs as complete as possible is performed with applied high voltage in the ionization zone, which on its part generates a field strength in the subsequent separating zone at lowest possible current which is sufficient for the transport and separation of the particles. A low defined current in the separating zone ensures that a certain follow-up guidance of charge carriers to the positive collecting electrode is achieved in order to substantially prevent the repeated swirling (re-entrainment) of already separated particles.

This is principally realized for different embodiments of electrostatic filters in such a way that in the individual ducts of the high-voltage zone with unchanged duct distance extremely different corona discharge distances are used in the ionization zone and in the separation zone by highly current-intensive or current-suppressing electrode shapes on a common high-voltage source, with the principle of the larger geometric corona discharge distance in the ionization zone and the lower geometric corona discharge distance in the separation zone being set to the highest extent. It is now possible to keep constant the duct width of the individual ducts, so that each ionization zone is associated with only one separation zone. Moreover, the sparkover activity does not start or only starts at such a late time that the electric power is not reduced substantially.

It is optionally possible to successively arrange several sections for ionization and separation within an electrostatic field when the single particle charge should prove to be insufficient.

BRIEF DESCRIPTION OF THE DRAWINGS

Several embodiments of the invention will be explained below in closer detail by reference to figures and diagrams shown schematically in the drawings, wherein:

FIG. 1 shows the particle separating behavior in an electrostatic filter;

FIG. 2 shows examples of the typical electric characteristic performance of the negative electrode shapes for the ionization zone and the separation zone of the method in accordance with the invention;

DETAILED DESCRIPTION OF THE INVENTION

FIG. 1 shows the particle separation behavior in an electrostatic filter. As a result of the physically effective charging mechanisms, i.e. the so-called surge or field charging and the diffusion charging, there is a more or less marked minimum of the particle fraction separation performance. This can clearly be seen in all illustrated curves.

FIG. 2 shows the amount to which the individual characteristics of the negative electrode geometries in question need to differ from each other so that the object in accordance with the invention can be achieved. The characteristics on the left part of the diagram correspond to the highly current-drawing electrode shapes (Type A, B and C) for the ionization zone, whereas the characteristics shown in the right part of the diagram correspond to the low-current electrode shapes (Type D, E and F) for the separation zone.

Figure 3:
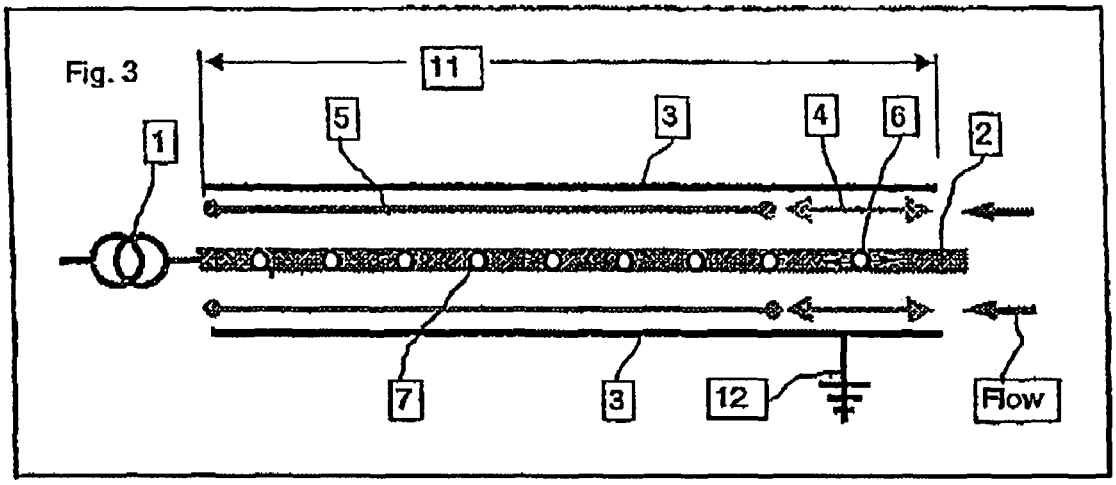
FIG. 3 shows a layout plan of a first embodiment of an individual separation duct of the separation apparatus in accordance with the invention.
Figure 4:
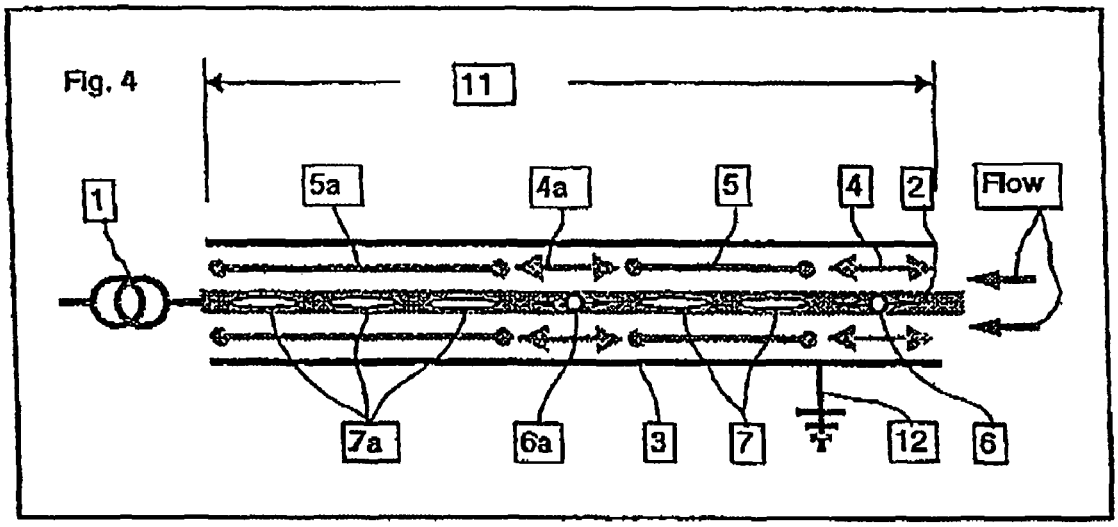
FIG. 4 shows a layout plan of a second embodiment of an individual separation duct of the separation apparatus in accordance with the invention.

FIG. 3 shows and overview of a single separation duct with the work sections of ionizing and separating. Adjacent analogous ducts are not shown. A high-volume system 2 is connected to a high-voltage power source 1, which system is provided with current-intensive discharge electrodes 6 and voltage-intensive or low-current negative electrodes 7. The discharge electrodes 6 are situated in an ionization zone 4 which is formed by the collecting electrodes grounded with reference numeral 12. The negative electrodes 7 are situated in a separation zone 5 which is also formed by the collecting electrodes 3. The entire high-voltage zone is marked with reference numeral 11. In the ionizing zone 4 which is also known as ionization zone, a sufficient charging of the particles is achieved which are then separated optimally in the following separation zone 5 with strongly reduced turbulences and virtually missing electric wind.

When the single particle charging in a high-voltage zone is insufficient for optimal separation, a further ionization region 4*a* with a separation zone 5*a* can be provided downstream of the ionization zone 4 and the separation zone 5.

Figure 5:
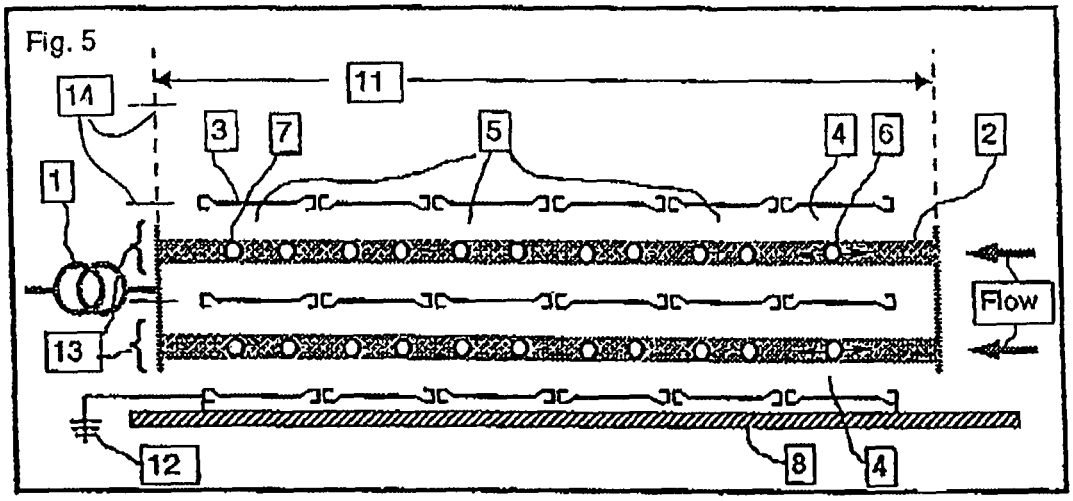
FIG. 5 shows a first embodiment of an electrostatic filter in accordance with the invention with two separating ducts and one ionization zone.

FIG. 5 shows a schematic illustration of a horizontally arranged electrostatic filter, a so-called horizontal field. Several rows of collecting electrodes 3 are provided here within a filter housing 8 with grounding 12, which electrodes form several separation ducts 13 which on their part comprise an ionization zone 4 with the current-intensive discharge electrodes 6 and a separation zone with low-current negative electrodes 7. The embodiment shown here comprises two separation ducts 13. Further separation ducts 13 can be connected, as is indicated with the broken lines 14.

Figure 6:
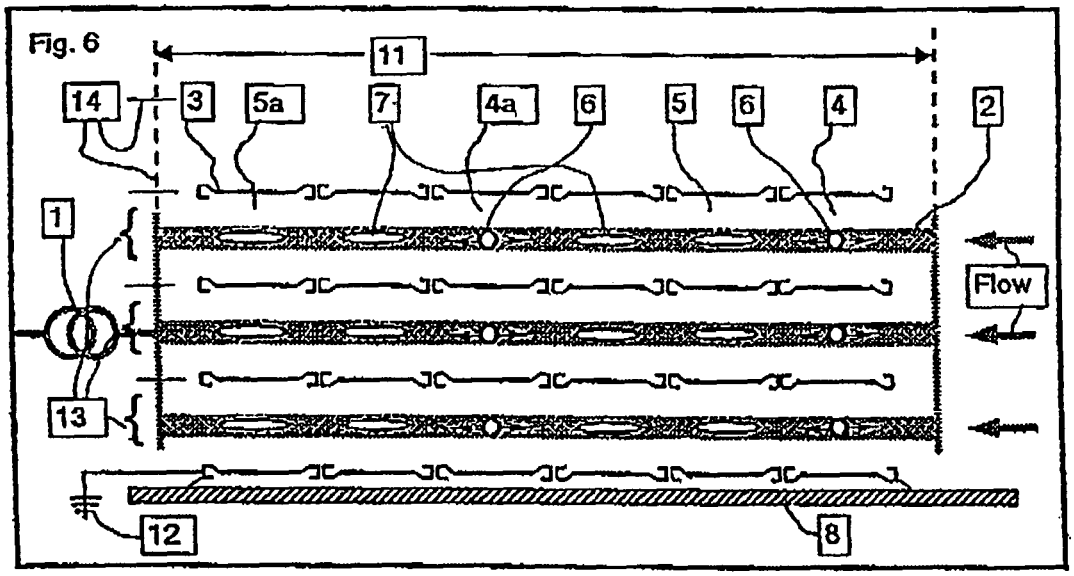
FIG. 6 shows a second embodiment of an electrostatic filter in accordance with the invention with three separating ducts and two ionization zones.

FIG. 6 shows a further embodiment of the electrostatic filter in accordance with the invention, with two ionization zones 4 and 4*a* and two separation zones 5 and 5*a* being arranged within the three illustrated separation ducts 13. Furthermore, with their elliptical form the negative electrodes 7 shown in FIG. 6 have another possible geometry.

Figure 7:
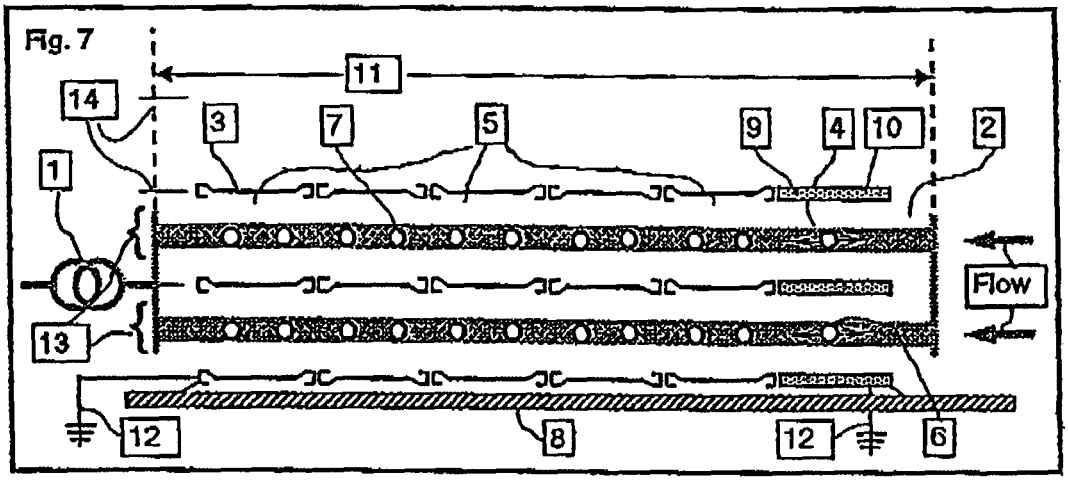
FIG. 7 shows a third embodiment of an electrostatic filter in accordance with the invention with two separating ducts with cooled collecting electrodes in the ionization zone.

FIG. 7 shows a third embodiment with an ionization zone 4, in which the collecting electrodes grounded with reference numeral 12 are arranged as hollow bodies (cooling chamber 10) which is flowed through by a coolant 9. This cooling helps prevent a re-ionization which is also known as back corona as a result of an extreme electric resistance of separated particles in the ionization zone 4.

The nature of the invention is clearly shown in the principal illustrations, namely to perform within a high-voltage zone 11 with its unchanged individual ducts 13 with only one high-voltage supply source 1 an optimal electric charging or ionization in the ionization zone 4, 4*a* and to ensure the subsequent particle separation in the separation zone 5, 5*a* at sufficient field strength.

The invention claimed is:

1. A method for separating dust-particles from industrial waste gases, in which dust-particles are difficult to separate are removed from a gas fluid, wherein the dust-particles being successively ionized and separated within a high-voltage zone which comprises one or several individual ducts with the help of electrostatic charging and separation by means of only one high-voltage supply source for this high-voltage zone, and wherein the dust-particles being ionized and separated both in ionization zones as well as in separation zones of the individual ducts by connected negative electrodes which are connected to the only one high-voltage supply source, characterized in that the high-voltage zone comprises one or several individual ducts of even duct width, in which the dust-particles are successively ionized and separated, wherein the connected negative electrodes are connected with only one output of the one high-voltage supply source and wherein by suitable choice of the negative electrode geometry for the ionization zones and separation zones a substantially higher current flow is generated in the ionization zones than in the separation zones, so that in the ionizing zones a sufficient charging of the dust-particles is achieved which are then separated optimally in the following separation zones.

2. A method according to claim 1, characterized in that the dust-particles are ionized and separated twice or several times successively within the individual ducts of the high-voltage zone in the manner of a series connection.

3. A method according to claim 1, characterized in that the grounded electrodes of the ionization zone are cooled.

4. An electrically working filter for separating dust-particles from industrial waste gases for performing the method according to one of the claims 1, 2 or 3, comprising a high-voltage zone with individual ducts each of comprising ionization zone with downstream separation zones, for successively ionizing and separating the dust-particles within the high-voltage zone with the help of electrostatic charging and separation by means of connected negative electrodes which are connected to only one high-voltage supply source, characterized in that the filter comprises one or several high-voltage zones (11), with both the ionization zones (4) as well as the separation zones (5) each being provided with different negative electrodes (6,7) which are connected in a joined manner to only one output of the one high-voltage supply source (1) wherein by a suitable choice of the negative electrode geometry for the ionization zones (4) and separation zones (5) a substantially higher current flow is generated in the ionization zones (4) than in the separation zones (5), so that in the ionizing zones (4) a sufficient charging of the dust-particles is achieved which are then separated optimally in the following separation zones (5).

5. An apparatus according to claim 4, characterized in that the geometries of the negative electrodes (6,7) for the ionization zones (4) and the separation zones (5) are provided with different configurations, with negative electrodes (6) in high-current-intensive corona discharge electrode forms being used for the ionization zones (4) and negative electrode (7) substantially low-current or voltage-intensive electrode forms (7) being used for the separation zones (5).

6. An apparatus according to claim 4, characterized in that several ionization zones (4, 4*a*) and separation zones (5, 5*a*) are arranged in the direction of flow of the gas fluids behind one another in the individual ducts of the high-voltage zone (11).

7. An apparatus according to claim 4, characterized in that the collecting electrodes (9) of the ionization zones (4) are provided with cooling chambers (10).

* * * * *